US006493454B1

(12) United States Patent
Loi et al.

(10) Patent No.: US 6,493,454 B1
(45) Date of Patent: Dec. 10, 2002

(54) HEARING AID

(75) Inventors: Teck Enn Loi, Putney (AU); Matthew James Hall, Frederiksberg (DK)

(73) Assignee: NHAS National Hearing Aids Systems, New South Wales (AU)

( * ) Notice: Subject to any disclaimer, the term of this patent is extended or adjusted under 35 U.S.C. 154(b) by 0 days.

(21) Appl. No.: 09/554,571

(22) PCT Filed: Oct. 27, 1998

(86) PCT No.: PCT/AU98/00888

§ 371 (c)(1),
(2), (4) Date: Jun. 12, 2000

(87) PCT Pub. No.: WO99/27755

PCT Pub. Date: Jun. 3, 1999

(30) Foreign Application Priority Data

Nov. 24, 1997 (AU) ..... PP 0520

(51) Int. Cl.[7] ..... H04R 25/00
(52) U.S. Cl. ..... 381/328; 381/322; 381/324
(58) Field of Search ..... 381/328, 322, 381/324, 325, FOR 133, FOR 135; 181/129, 130, 134, 135

(56) References Cited

U.S. PATENT DOCUMENTS

| | | | | |
|---|---|---|---|---|
| 4,471,490 A | | 9/1984 | Bellafiore | 381/69 |
| 4,634,815 A | * | 1/1987 | Marquis | 381/328 |
| 5,201,008 A | * | 4/1993 | Arndt et al. | |
| 5,790,672 A | * | 8/1998 | Klostermeier | 381/328 |

FOREIGN PATENT DOCUMENTS

| | | |
|---|---|---|
| DE | 8106942 | 8/1982 |

* cited by examiner

*Primary Examiner*—Sinh Tran
(74) *Attorney, Agent, or Firm*—Ladas & Parry

(57) ABSTRACT

A hearing aid includes a faceplate (2) and a matching adaptor plate (4) below it. These plates are held in together by fasteners such as clips or screws (12). The faceplate and adaptor plate are custom cut and trimmed to seamless match a custom shell (9). Only the adaptor plate (4) is glued to the shell (9). A boundary (5*b*) between the faceplate (2) and the adaptor (4) is not visible on the hearing aid when worn by a user. Furthermore, the position of boundary B enables a reduction in the visible surface area of the faceplate (2) to be achieved.

6 Claims, 3 Drawing Sheets

HEARING AID

TECHNICAL FIELD

The present invention relates to hearing aids and, in particular, to an "in the ear" (ITE) hearing aid.

BACKGROUND OF THE INVENTION

ITE (In The Ear) hearing aids appeared in the early 1970's, and have become the most popular type of hearing aid currently used. Depending on the space occupied by the hearing aid, ITE hearing aids have been further categorised as Completely-In-Canal (CIC), In-The-Canal ITC), Half Concha (ITE) and Full Concha (ITE). The term ITE as used herein applies to all these categories of hearing aids.

The internal components of ITE hearing aids are generally housed in earshells which are custom made to fit the intended wearer's ear. Components which make up the hearing aid, such as the battery holder, contacts, microphone, amplifier, switches and other user controls are built in a cluster on a plastic plate which is commonly called a faceplate. An earshell custom made to fit each individual ear is made in accordance with an impression made of the ear. The faceplate is trimmed to match the earshell. With the earphone mounted in the shell, the trimmed faceplate is bonded to the custom earshell with a solvent glue or adhesive. This form of construction is often referred to as a custom ITE.

Alternatively, the bulk of the components can be built in the form of a module. The module generally fits into an adaptor plate and is removably held onto the adaptor plate by fasteners such as screws or clips. The adaptor plate is then glued to the customised earshell, and trimmed to physically match the custom shell. The most common form of this construction is often referred to as semi-modular. This term is used because the earphone is generally mounted in the shell by means of an output tube which is glued to the shell at the shell tip. When the module is unfastened from the adaptor, the earphone wiring is still connecting the module and the custom earshell.

Custom ITE hearing aids are often difficult and time consuming to repair, as the faceplate must be removed from the earshell to allow access to the components. Modular or semi-modular ITE hearing aids are easier to repair than custom hearing aids, as the module on which the components are mounted is easier to remove and replace. However, the smallest possible size of the module dictates the size of the outer surface of the hearing aid, as the adaptor used to attach the module to the earshell must not be cut too close to the join between the adaptor and the module. Further, this join is usually cosmetically unappealing. It is not practical to add any desired additional components on the aid even though the shell opening may be sufficiently larger than the module to accommodate such components.

OBJECT OF THE INVENTION

It is an object of the present invention to overcome or substantially ameliorate at least some of the above disadvantages.

SUMMARY OF THE INVENTION

The present invention in one broad form provides an in-ear type hearing aid comprising:

a shell for placement in an ear, said shell comprising an outer opening, said shell being adapted to house electrical components therein;

a top plate having an outer periphery; and a bottom plate having an outer periphery and an opening, said bottom plate being fixed to said shell over said opening in said shell, said top plate being removably attached to said bottom plate, wherein the outer periphery of said top plate substantially corresponds in size and shape to the outer periphery of said bottom plate.

Preferably, at least some of said electrical components are mounted on said top plate and extend into the shell through said opening in said bottom plate. Examples of these electrical components include a battery, microphone, and amplifier, but may also include components such as a volume control, on/off switch, telecoil selector, program selector etc.

Preferably, said bottom plate is glued, adhered by means of a solvent, or fused onto the shell around its outer periphery.

Preferably, said top plate is releasably attached to the bottom plate by means of one or more screws.

Preferably, the outer peripheries of said bottom plate and said top plate correspond in size and shape to said outer opening in said shell.

The present invention in another broad form provides a method of assembling a hearing aid, said method comprising the steps of:

providing a shell for placement at least partly within an ear, said shell comprising an outer opening;

providing a bottom plate at least as large as the outer opening in said shell, said bottom plate comprising an opening;

providing a top plate at least as large as the outer opening in said shell;

releasably mounting said top plate on said bottom plate;

fixing said bottom plate onto said shell over said outer opening; and trimming the outer peripheries of said top plate and said bottom plate to substantially the same size and shape.

Preferably, the bottom plate and top plate are trimmed to substantially the same size and shape as the outer opening in said shell.

Preferably, said method further comprises the step of mounting one or more electrical components onto said top plate, said electrical components extending into said shell through said opening in said bottom plate.

The present invention in another broad form provides, in combination:

a top plate removably mounted on a bottom plate, said bottom plate adapted to be fixed onto a shell of an in-the-ear type hearing aid over an outer opening in said shell, said bottom plate having an opening therein, wherein the outer peripheries of said top plate and said bottom plate are substantially the same shape and size.

Preferably, one or more electrical components are mounted on said top plate and extend into said shell through said opening in said bottom plate.

BRIEF DESCRIPTION OF THE DRAWINGS

Preferred forms of the present invention will now be described by way of example with reference to the accompanying drawings wherein.

DETAILED DESCRIPTION OF THE PREFERRED EMBODIMENTS

Figure 1:
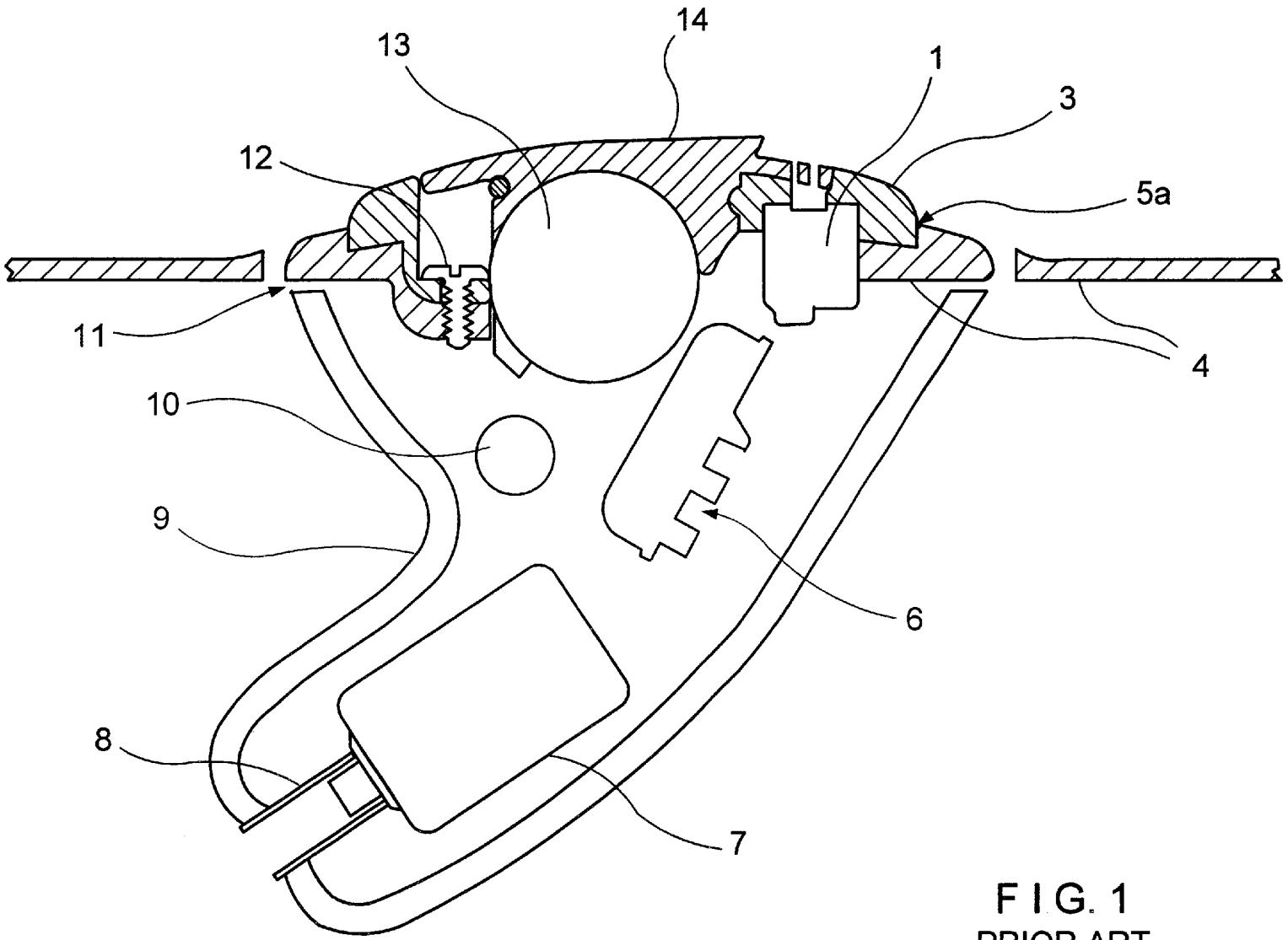
FIG. 1 PRIOR ART
FIG. 1 is a cross section of a known semi-modular hearing aid.

Similar reference numerals are used throughout the drawings indicate similar components.

FIG. 1 illustrates the construction of a known semi-modular custom type of hearing aid. Components such as a microphone 1, coil 10, battery holder and cover 14, battery contacts (not shown) and amplifier 6 are built on a plastic frame or body 3 in fixed positions. Additional components which may be included in some models are also built on the body. These additional components may include volume control, a programming socket, a program selector, a microphone-telecoil selector and an on/off switch. The position of the amplifier 6 may not be fixed but is usually close to the module 3 as there are numerous connections therebetween. The earphone 7 is generally built with the module but physically connected with wires (not shown) which are long enough to allow mounting of the earphone 7 in the earshell 9 The earphone tube 8 is glued to the tip of the earshell 9. An adaptor plate 4 is cur and trimmed to match the earshell 9 which is custom made for each individual ear. The trimmed adaptor plate 4 is attached to the shell by solvent or adhesive 11. After the earphone is mounted in the shell, the assembly is completed by mounting the module 3 onto the adaptor 4 The module is held in place by fixtures 12 such as screws, clips or jams.

The module and adaptor boundary 5*a* is on the visible surface of the hearing aid when worn. The boundary 5*a* is fixed and is generally determined by the shape of the module 3. The adaptor plate 4 can be trimmed close to but not directly up to the module boundary. For cosmetic reasons some designs attempt to hide this visible boundary from view by enlarging the battery cover 14. However, the above described problems still exist.

With a modular or semi-modular construction, ungluing of the shell 9 from the remainder of the hearing aid is not required for most repairs, as the body 3 (along with the components assembled thereon), can be unscrewed from the adaptor plate 4 and replaced.

Figure 2:
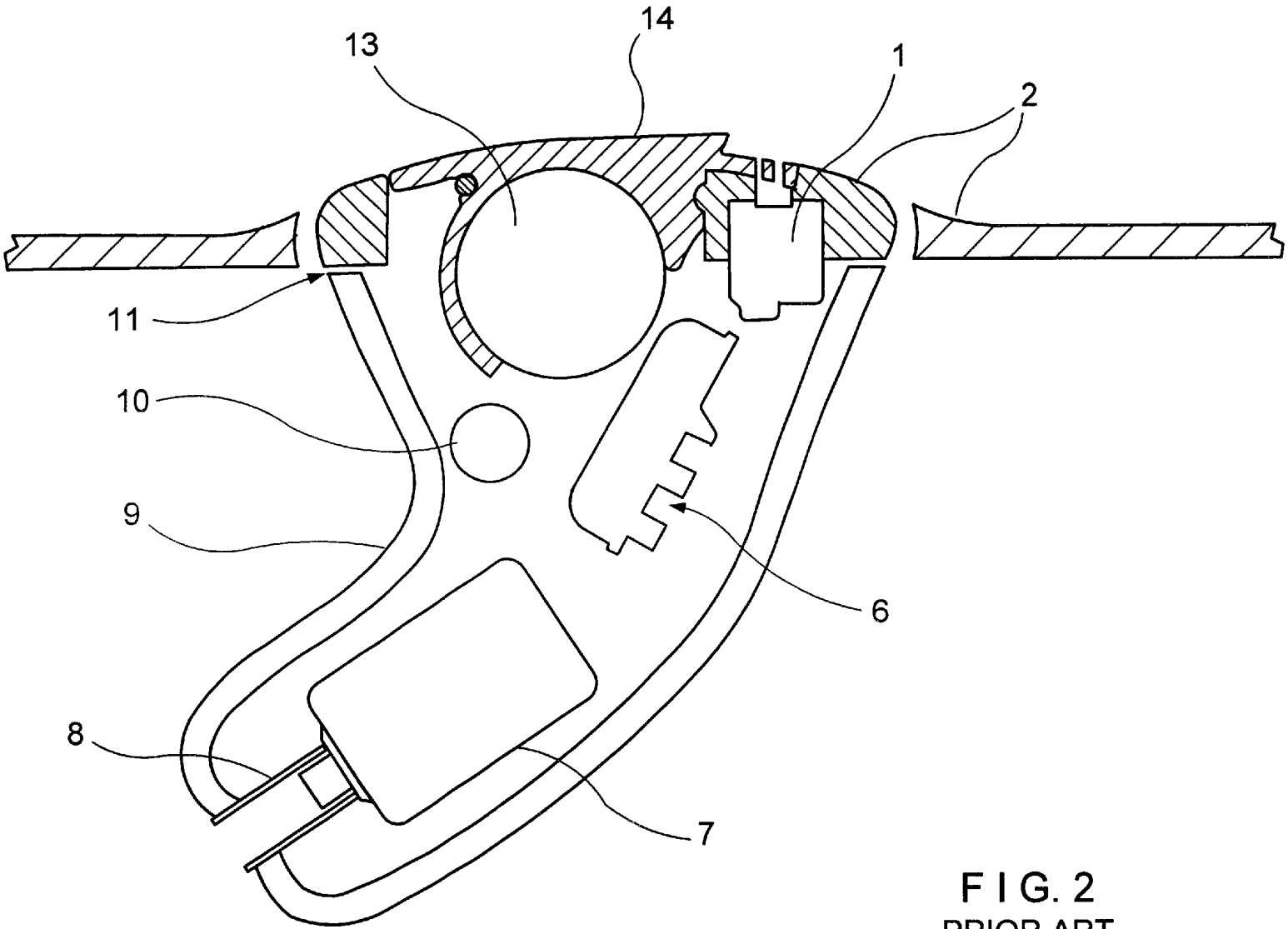
FIG. 2 PRIOR ART
FIG. 2 is a cross section of a known custom hearing aid.

FIG. 2 illustrates the construction of a known custom hearing aid. The custom hearing aid comprises a single faceplate 2 (commonly referred to as the custom faceplate) instead of the module body and adaptor plate employed by the semi-modular hearing aid illustrated in FIG. 1. Components of the custom hearing aid are built onto the faceplate 2. The faceplate 2 is custom trimmed and then attached to the shell 9 by a solvent glue or an adhesive. The (horizontal) boundary 5*a* visible in the semimodular hearing aid shown in FIG. 1 is not present. If other components such as a volume control are desired, and the shell 9 is large enough, these components are accommodated within the trimmed area of the faceplate 2. Custom hearing aids can be made smaller than modular aids as the boundary 5*a* on the modular aid takes up additional volume and surface area.

Figure 3:
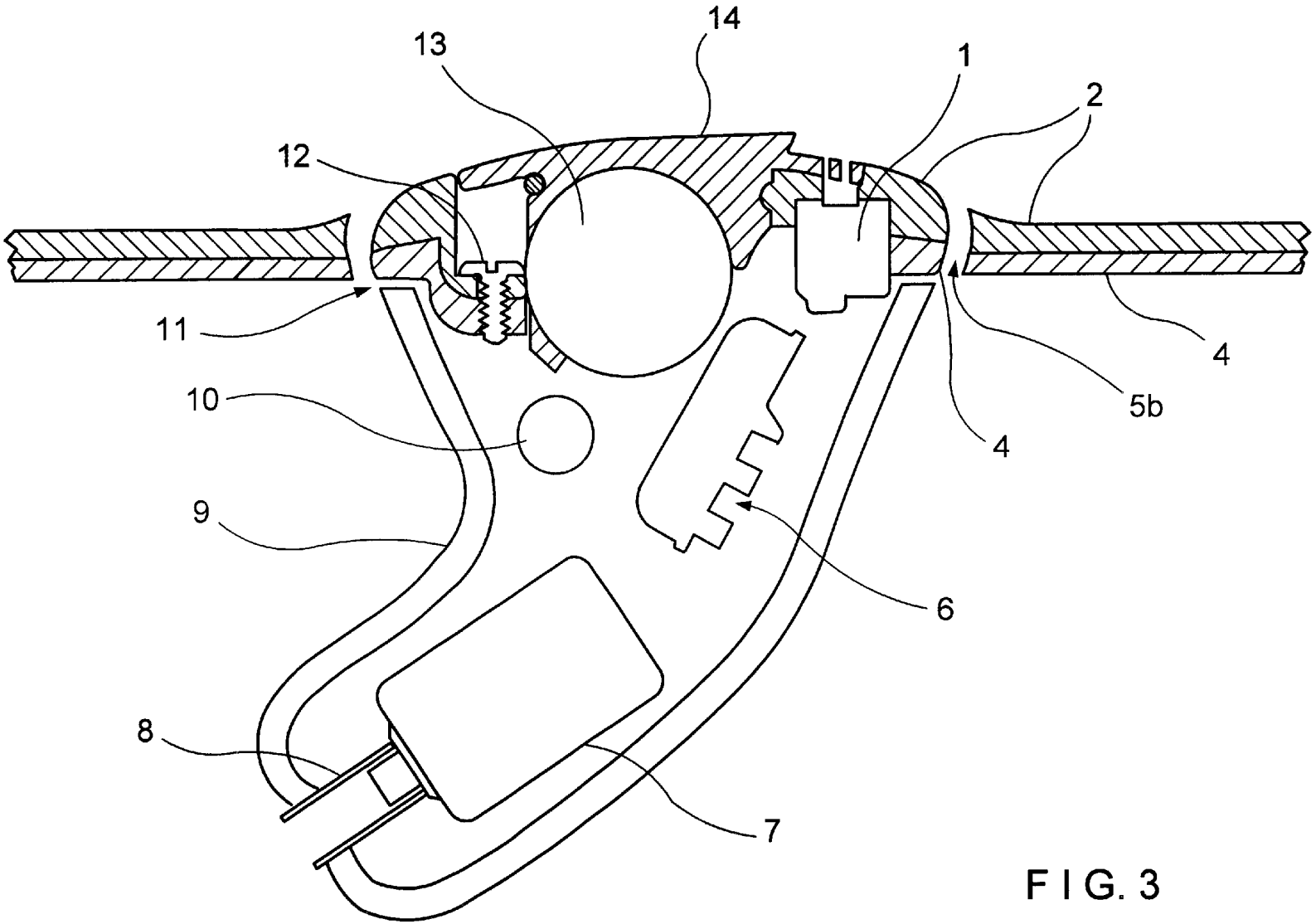
FIG. 3 is a cross-section of a preferred embodiment of the present invention.

FIG. 3 illustrates a preferred embodiment of the present invention. A conventional faceplate 2, on which components are mounted has a matching adaptor plate 4 below it. The two layers are held together by fasteners such as clips or screws 12. Both layers are custom cut and trimmed to seamlessly match the custom shell 9 Only the adaptor plate 4 is glued to the shell 9. The peripheral surfaces at which the faceplate 2 and adaptor plate 4 are in transition are indicated by reference 5*b* in FIG. 3. This boundary surface is substantially vertical (taken in the orientation of FIG. 3) and therefore the join line at die boundary 5*b* is not visible when the hearing aid is in use. By comparison, the transition line 5*a* in the prior art embodiment of FIG. 1 for example is clearly visible when the hearing aid of FIG. 1 is in use. Further, this boundary 5*b* does not take up any surface area on the outside of the hearing aid, and does not impose a fixed surface shape on the hearing aid. If another component, such as a volume control, is desired, and the shell 9 is large enough, it can be added on within the trimmed area of the faceplate 2. The advantages of a modular hearing aid are retained, as the faceplate 2 on which the components of the hearing aid are mounted can be removed for repair by simply unscrewing the screw 12, and then replaced. It can be seen that the present invention is suitable for both modular and semi-modular hearing aids.

What is claimed is:

1. An in-ear type hearing aid comprising:

a shell for placement in an ear, said shell having an outer opening, said shell being adapted to house electrical components therein;

a top plate having an outer periphery, most of said electrical components being mounted on said top plate; and a bottom plate having an outer periphery and an opening, said bottom plate being fixed to said shell over said opening in said shell, said top plate being removably attached to said bottom plate, wherein the outer periphery of said top plate substantially corresponds in size and shape to the outer periphery of said bottom plate and said most of said electrical components mounted on said top plate extend into the shell through said opening in said bottom plate, the outer peripheries of said bottom plate and said top plate correspond in size and shape to said outer opening in said shell.

2. The hearing aid of claim 1, wherein said bottom plate is secured to the shell around its outer periphery.

3. The hearing aid of claim 1, wherein said top plate is removably attached to the bottom plate by means of one or more screws.

4. The hearing aid of claim 1, wherein said most of said electrical components include a battery, microphone and amplifier.

5. The hearing aid of claim 4, wherein said most of said electrical components further include at least one of a volume control, on/off switch, telecoil selector and program selector.

6. A method of assembling a hearing aid, said method comprising the steps of:

providing a shell for placement at least partly within an ear, said shell having an outer opening;

providing a bottom plate at least as large as the outer opening in said shell, said bottom plate having an opening;

providing a top plate at least as large as the outer opening in said shelf;

mounting most of a number of electrical components for said hearing aid onto said top plate;

fixing said bottom plate onto said shell over said outer opening;

releasably mounting said top plate on said bottom plate with said electrical components extending into said shell through said opening in said bottom plate; and trimming the outer peripheries of said top plate and said bottom plate to substantially the same size and shape as the outer opening in said shell.

* * * * *